US005299876A

United States Patent [19]

Singarella

[11] Patent Number: 5,299,876

[45] Date of Patent: Apr. 5, 1994

[54] SURFACE CLEANING DEVICE

[76] Inventor: Christopher F. Singarella, 56 Middle Rd., Ellington, Conn. 06279

[21] Appl. No.: 653,694

[22] Filed: Feb. 11, 1991

[51] Int. Cl.[5] ..... A47L 1/08; A47L 1/06

[52] U.S. Cl. ..... 401/139; 401/14; 401/22; 401/27; 401/137

[58] Field of Search ..... 401/139, 137, 27, 14, 401/22, 23

[56] References Cited

U.S. PATENT DOCUMENTS

| | | | |
|---|---|---|---|
| 402,814 | 5/1889 | Draper . | |
| 2,477,777 | 8/1949 | Williams, Jr. | 401/14 |
| 2,707,292 | 5/1955 | Lustbader | 401/139 |
| 2,741,789 | 4/1956 | Ray . | |
| 2,859,463 | 11/1958 | Hirsch . | |
| 2,886,839 | 5/1959 | Leopoldi . | |
| 3,011,499 | 12/1961 | Tajan . | |
| 3,137,885 | 6/1964 | Hulsh . | |
| 3,238,555 | 3/1966 | Cels | 401/22 X |
| 3,722,021 | 3/1973 | Brainerd et al. . | |
| 3,979,163 | 9/1976 | Beard . | |
| 4,516,676 | 5/1985 | Cournoyer | 401/139 X |

FOREIGN PATENT DOCUMENTS

| | | | |
|---|---|---|---|
| 2472927 | 7/1981 | France | 401/139 |
| 352473 | 4/1961 | Switzerland | 401/23 |
| 381236 | 10/1932 | United Kingdom | 401/14 |
| 854652 | 11/1960 | United Kingdom | 401/23 |

*Primary Examiner*—Steven A. Bratlie

*Attorney, Agent, or Firm*—Fishman, Dionne & Cantor

[57] ABSTRACT

A cleaning device including a container for a cleaning liquid, a sprayer for discharging liquid from the container, an elastomeric extrusion surrounding the container, an integral wiper, extending along the extrusion, for wiping a surface and a sponge, bonded to the extrusion, for scrubbing a surface. The container, sponge and wiper one each oriented parallel to a single longitudinal axis.

14 Claims, 2 Drawing Sheets

SURFACE CLEANING DEVICE

TECHNICAL FIELD

The present invention relates to cleaning devices.

BACKGROUND OF THE INVENTION

Self contained window cleaning devices are known and are described in, e.g. U.S. Pat. Nos. 2,742,789 (Ray) 2,859,463 (Hirsch) and 2,886,839 (Leopoldi).

Ray describes a window washer including an elongated fluid container and a plunger operated fluid ejector mounted on the container. An elongated sponge and separate wiper blade are secured to the container by a bracket. The longitudinal axis of the sponge and wiper blade are transverse to the longitudinal axis of the container.

Hirsch describes a window cleaning implement which includes a rigid base member, a first clip for securing a container of a cleansing liquid to the base member and a resilient pad secured to the base member. A pair of second clips for securing multiple layers of a soft liquid absorbent material over the resilient pad and a squeegee secured to the first clip are also provided.

Leopoldi describes a window cleaning device which includes a resiliently compressable container having a pair of opposed narrow sidewalls and provided with a spray top. A squeegee is integrally formed with the container along one sidewall and a block of sponge material is bonded to the container along the opposite sidewall. A rigid scraper plate is removably secureable to the container to reinforce the container so that the container may be used as a handle for the squeegee without distorting the working edge of the squeegee.

None of these prior art devices is, however, wholly satisfactory. The devices described by Ray and Hirsch are somewhat complex and cumbersome and the device describe by Leopoldi, although more compact than the other two devices, requires a tradeoff in performance since the container and integral squeegee are formed from the same material.

SUMMARY OF THE INVENTION

A device for cleaning a surface is disclosed. The device includes an elastomeric sleeve. The elastomeric sleeve includes a tubular wall that extends along a longitudinal axis and includes an inner surface and an outer surface. The device further includes container means, secured within said tubular wall, for containing a liquid, means for discharging liquid from the container means, porous means, extending longitudinally along the outer surface of the tubular wall, for scrubbing the surface to be cleaned and wiper means, extending longitudinally along the outer surface of the tubular wall, for wiping the surface to be cleaned. The device is simple, compact and provides a substantially rigid container and a soft elastomeric wiper.

In a preferred embodiment, the porous means comprise a sponge adhesively bonded to the outer surface of the tubular sleeve.

In a preferred embodiment, the wiper means includes a wiper head and stem means for connecting the wiper head to the sleeve. The wiper head exhibits a substantially triangular cross sectional shape and includes a base and a pair of sides converging toward a wiper edge.

DETAILED DESCRIPTION OF THE INVENTION

Figure 1:
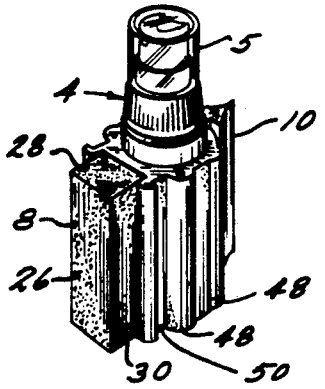
FIG. 1 shows a perspective view of a device of the present invention.
Figure 3:
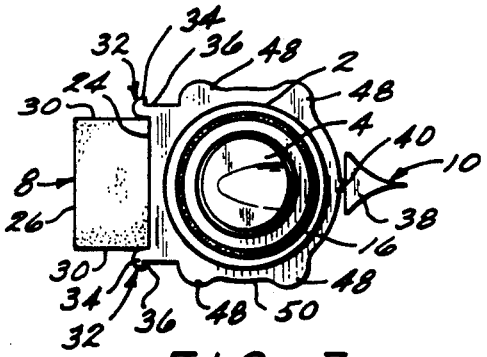
FIG. 3 shows a top view of the device shown in FIG. 1.
Figure 2:
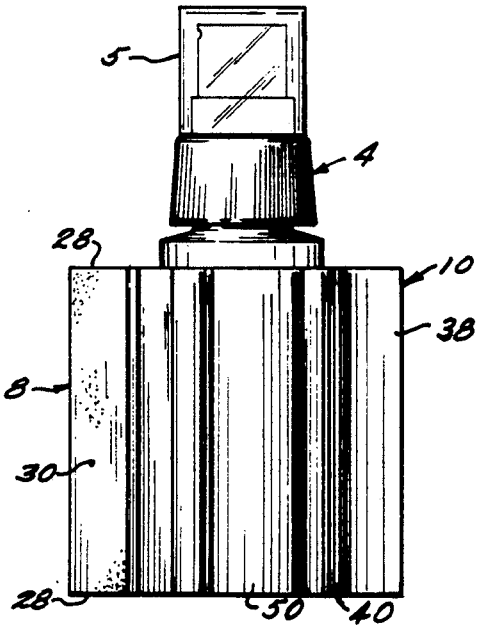
FIG. 2 shows a side view of the device shown in FIG. 1.
Figure 4:
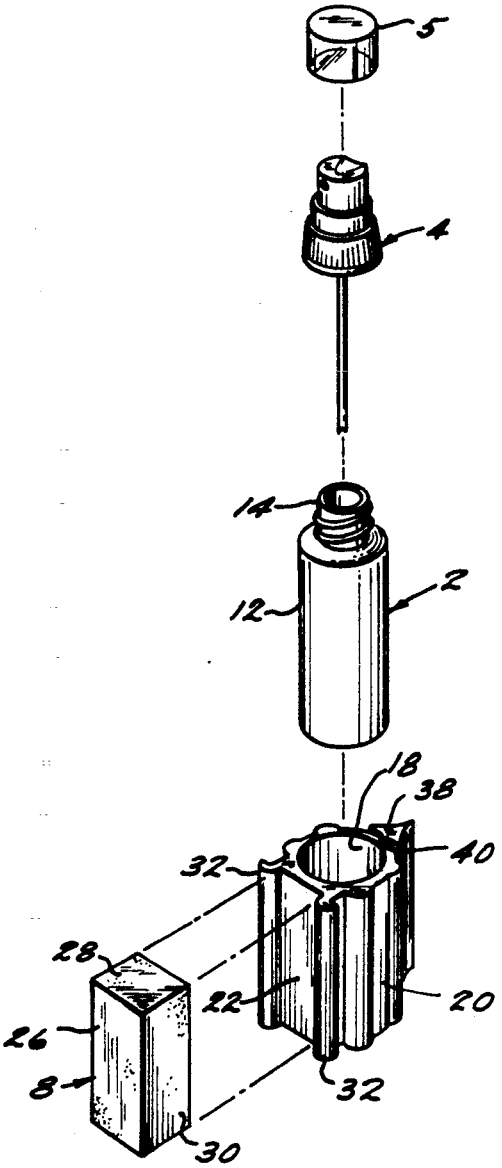
FIG. 4 shows an exploded perspective view of the device shown in FIG. 1.

Referring to FIGS. 1–4, the device of the present invention includes a longitudinally extending container 2, a sprayer 4, a longitudinally extending elastomeric sleeve 6, a longitudinally extending sponge 8 and a longitudinally extending wiper 10.

The container 2 extends along a central axis of rotation and includes a right circular cylindrical body 12 and a threaded neck 14. The container 2 is substantially rigid and supports the elastomeric sleeve 6. Preferably, the container 2 comprises a thermoplastic polymer, e.g. high density polyethylene. The container 2 may contain any liquid, e.g. water or a cleaning solution, suitable for use in cleaning a surface. The sprayer 4 is a conventional plunger type liquid spray applicator and is threadably secured to the neck 14 of the container to seal the container 2 and to provide a means for discharging liquid from the container 2. A cap 5 is provided to cover the sprayer 4 and prevent unintentional discharge of liquid from the container 2.

The elastomeric sleeve 6 includes a tubular wall portion 16 having an inner surface 18 and an outer surface 20 and having an inner diameter that is slightly less than the outer diameter of the cylindrical container body 12. The tubular wall 16 radially surrounds the container body 12 and exerts a compressive force on the container body 12 so that the inner surface 18 of the tubular wall portion 16 of the elastomeric sleeve 6 grips the container body 12. The elastomeric sleeve 6 includes a mounting platform 22 which provides a flat exterior area on the tubular wall 16 for mounting the sponge 8. Preferably, the elastomeric sleeve comprises styrene-butadiene block copolymer.

The sponge 8 includes a flat rectangular back surface 24, a flat rectangular front surface 26 opposite the back surface, and two opposed pairs of flat rectangular side surfaces 28, 30 extending between the opposed back surface 28 and front surface 26. The back surface 24 is adhesively secured to the mounting platform 22 of the elastomeric sleeve with a conventional adhesive formulation e.g. a cyanoacrylate adhesive. The sponge 8 may comprise any natural or synthetic elastomeric open cell foam material that is resistant to suitable cleaning liquids. Preferably, the sponge 8 comprises a urethane-polyester foam.

Figure 5:
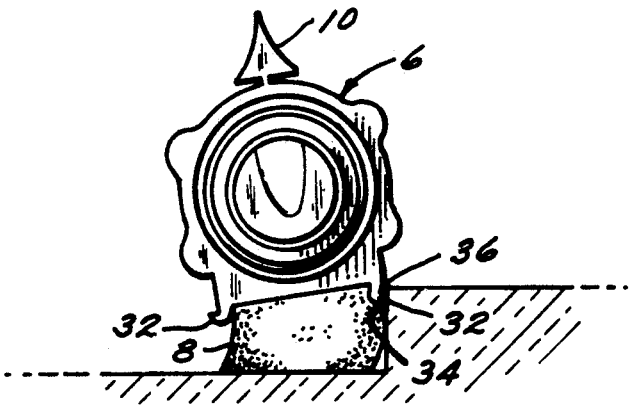
FIG. 5 shows a transverse cross sectional view of the device shown in FIG. 1.
Figure 6:
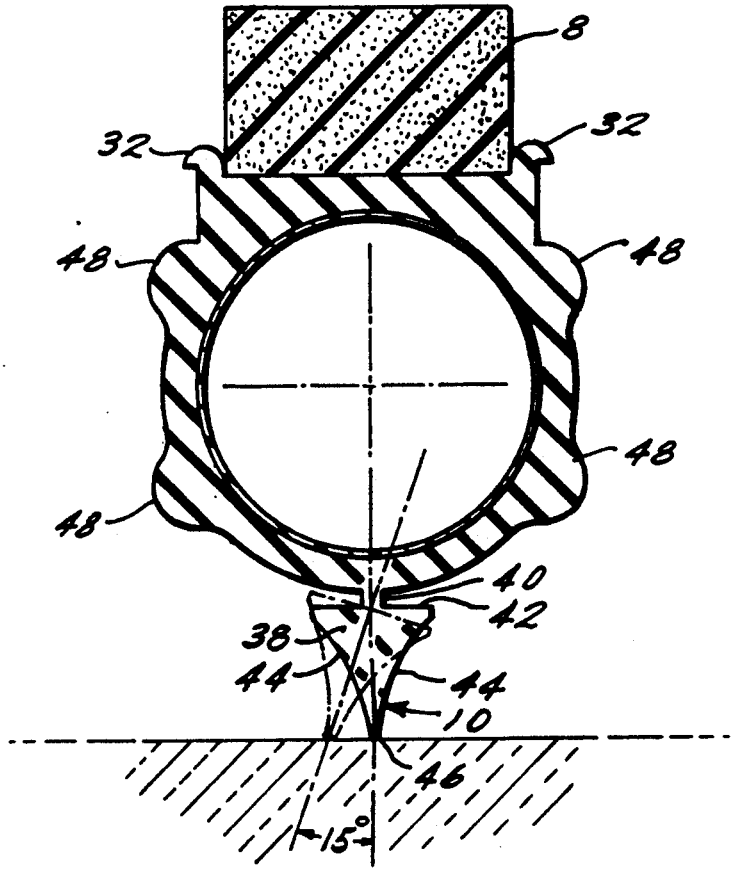
FIG. 6 shows a transverse cross sectional view.

The elastomeric sleeve 6 includes a pair of longitudinally extending bosses 32 extending along opposite sides of the mounting platform 22. Each boss includes a head portion 34 and a stem portion 36. The stem portion extends between the mounting platform 22 and the head portion 34 and protects the adhesive bond between the mounting platform 22 and the sponge 8 form shearing forces, i. e. forces which would otherwise be applied to the adhesive bond in a direction parallel to the plane of the bond. Potential shearing forces may be encountered, e.g. if the device of the present invention collides with a peripheral obstruction during use of the sponge 8. Referring to FIG. 5, the head portion 34 contacts such an obstruction and stem portion 36 deforms to apply a compressive force to the adhesive bond.

The elastomeric sleeve 6 includes an integral longitudinally extending wiper 10 opposite the mounting platform 22. The wiper 10 includes a wiper head 38 and a wiper stem 40. The wiper head 38 exhibits a substantially triangular cross sectional shape in planes transverse to the longitudinal axis. The wiper head 38 includes a base 42 and a pair of sides 44 converging from the base 42 to a flattened edge 46 at the apex of the triangle. The sides 44 are slightly curved so that the portion of the wiper head 34 near the flattened edge 46 is thinner and thus more flexible than could be the case if the side 44 were straight and the cross sectional shape of the head even more closely approached a triangular shape. The wiper stem 40 extends between the midpoint of the base 42 and the tubular wall 16. The lengths of the base 42 and wiper stem 40 are chosen in relation to each other and to the outer circumference of the tubular wall 16 so that the wiper head may be pivoted 15° from a plane passing from the axis of rotation of the cylinder through the centerline of the flattened edge 46, i.e. so that the flattened edge 46 may be pivoted to sweep out an arc of about 30° relative to a stationary tubular wall 16.

The elastomeric sleeve includes two pairs of longitudinally extending ribs 48 which define a pair of diametrically opposite gripping areas 50 on the outer surface of the tubular wall between each respective pair of ribs 48.

Since the components of the present device, i.e. the container 2, the sponge 8, and the wiper 10, each extend parallel to a single longitudinal axis the device of the present invention is very simple and compact. The elastomeric sleeve 6 incorporates the integral wiper 10, mounting platform 22, bosses 32 and ribs 48 and may be extruded in one piece.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. A device for cleaning a surface, comprising:

an elastomeric sleeve, said sleeve comprising:

a tubular wall, said tubular wall extending along a longitudinal axis and having an inner surface and an outer surface, and wiper means, extending longitudinally along the outer surface of the tubular wall and integrally formed with said tubular wall, for wiping the surface to be cleaned;

container means, secured within said tubular wall, for containing a liquid;

means for discharging liquid from the container means;

porous means, extending longitudinally along the outer surface of the tubular wall, for scrubbing the surface to be cleaned.

2. The device of claim 1, wherein said elastomeric sleeve comprises a sytrene butadiene block copolymer.

3. The device of claim 1, wherein the container means comprises a thermoplastic polymer.

4. The device of claim 1, wherein the container means is substantially rigid and supports the elastomeric sleeve.

5. The device of claim 1, wherein the means for discharging discharges liquid in the form of a mist.

6. The device of claim 1, wherein the porous means comprises a sponge.

7. The device of claim 6, wherein the sponge includes opposed longitudinally extending front and back surfaces and opposed longitudinally extending side surfaces extending between said front and back surfaces and wherein said back surface of said sponge is secured to said outer surface of said sleeve by an adhesive bond.

8. The device of claim 7, wherein said elastomeric sleeve further comprises:

boss means, extending longitudinally along the outer surface of said sleeve along each side surface of said sponge, for protecting said adhesive bond from shearing deformation.

9. The device of claim 8, wherein the boss means comprises:

a head; and stem means, extending from the outer surface of the sleeve to the head, for connecting said head to said sleeve; and wherein the boss means protects the adhesive bond from shearing deformation by deforming, in response to a shearing force, to apply a compressive force to the adhesive bond.

10. The device of claim 1, wherein said tubular wall exhibits a substantially circular cross sectional shape transverse to the longitudinal axis and said wiper means comprises:

a wiper head extending longitudinally along said outer surface of said tubular wall, said head having a substantially triangular cross sectional shape and including a base and a pair of sides, said sides each converging toward a flattened wiper edge; and flexible stem means, extending radially outwardly from said outer surface of said sleeve to said base of said wiper head, for connecting said wiper head to said sleeve.

11. The device of claim 10, wherein said flattened wiper edge is oriented radially outwardly from said cuter surface and said stem means allows pivotal movement of said wiper head relative to said sleeve so that the flattened wiper head sweeps out an arc of about 30°.

12. The device of claim 1, wherein said tubular wall and container means each exhibit substantially circular cross section shapes transverse to the longitudinal axis, the porous means extends radially from said tubular wall in a first direction, said wiper means extends radially from the tubular wall in a second direction and wherein the first and second directions are diametrically opposite.

13. The device of claim 12, wherein said elastomeric sleeve further comprises longitudinally extending grip means on said outer surface of the tubular wall for facilitating manually gripping said outer surface.

14. The device of claim 13, wherein said grip means comprises a plurality of radially projecting ribs for defining diametrically opposite gripping areas on said outer surface.

* * * * *